US006695598B2

(12) United States Patent
Fujita et al.

(10) Patent No.: US 6,695,598 B2
(45) Date of Patent: Feb. 24, 2004

(54) SCROLL COMPRESSOR

(75) Inventors: Katsuhiro Fujita, Nishi-kasugai-gun (JP); Takahide Itoh, Nagoya (JP); Makoto Takeuchi, Nagoya (JP); Tetsuzou Ukai, Nishi-kasugai-gun (JP); Hiroshi Ogawa, Nagoya (JP); Shigeki Miura, Nishi-kasugai-gun (JP); Yasuhiro Wada, Nishi-kasugai-gun (JP); Yasuharu Maruiwa, Nagoya (JP); Kou Tanaka, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/040,631

(22) Filed: Jan. 9, 2002

(65) Prior Publication Data

US 2002/0094292 A1 Jul. 18, 2002

(30) Foreign Application Priority Data

Jan. 17, 2001 (JP) ..... 2001-009392
Jan. 17, 2001 (JP) ..... 2001-009393

(51) Int. Cl.[7] ..... F04C 18/00
(52) U.S. Cl. ..... 418/55.2
(58) Field of Search ..... 418/55.2

(56) References Cited

U.S. PATENT DOCUMENTS 4,498,852 A * 2/1985 Hiraga ..... 418/55.2
4,594,061 A * 6/1986 Terauchi ..... 418/55.2
5,037,279 A * 8/1991 Suefuji et al. ..... 418/55.2
5,059,102 A * 10/1991 Tokumitsu et al. ..... 418/55.2
5,765,999 A * 6/1998 Ito et al. ..... 418/55.2
5,944,500 A * 8/1999 Iizuka ..... 418/55.2

FOREIGN PATENT DOCUMENTS

JP 59-58187 4/1984
JP 63201385 A * 8/1988 ..... F04C/18/02
JP 9-68177 3/1997
JP 10-68392 3/1998

OTHER PUBLICATIONS

U.S. patent application Ser. No. 10/040,631, Fujita et al., filed Jan. 09, 2002.
U.S. patent application Ser. No. 10/414,015, Takeuchi et al., filed Apr. 16, 2003.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A scroll compressor comprises a fixed scroll member and a revolving scroll member that engage with each other with their centrifugal walls, wherein the revolving scroll member is supported to revolve with respect to the fixed scroll member, but to avoid self-rotation thereof. The spiral-starting portion of the centrifugal wall comprises non-stepped portions formed along curves of β1–β1' and β2–β2' respectively, and a stepped portion formed along a curve β1'–β2' that provides a thickness increase area encompassed by its upper-side curved surface and its lower-side curved surface. The discharge port is located on the end board of the fixed scroll member to partly overlap with the thickness increase area by partly hollowing the lower side of the stepped portion with the prescribed height.

3 Claims, 11 Drawing Sheets

SCROLL COMPRESSOR

BACKGROUND OF THE INVENTION

1. Field of the Invention

This invention relates to scroll compressors installed in air conditioners, refrigerators and the like.

2. Description of the Related Art

Scroll compressors are composed of fixed scroll members and revolving scroll members (i.e., pairs of scroll members) whose centrifugal walls (or spiral walls) are arranged in engagement with each other and which are subjected to revolving motions. That is, the scroll compressor operates in such a way that the revolving scroll member revolves with respect to the fixed scroll member. Thus, it performs fluid compression of its compression space, which is formed between the walls of the scroll members, and is gradually reduced in volume during compression.

FIGS. 7A and 7B show a pair of scroll members that are installed in the conventional scroll compressor described above. FIG. 8 is a plan view diagrammatically showing a center portion of a centrifugal wall of a scroll member, which is installed in the scroll compressor disclosed in Japanese Unexamined Patent Publication No. Sho 59-58187. FIGS. 9A and 9B diagrammatically show a center portion of a centrifugal wall of a scroll member, which is installed in the scroll compressor disclosed in Japanese Unexamined Patent Publication No. Hei 9-68177. FIG. 10 is a plan view diagrammatically showing a center portion of a centrifugal wall of a scroll member, which is installed in the scroll compressor disclosed in Japanese Unexamined Patent Publication No. Hei 10-68392.

Operations of the aforementioned scroll compressors having paired scroll members will be discussed below.

A first example of the scroll compressor has a combination of a fixed scroll member 1 shown in FIG. 7A in which a centrifugal wall 1*b* is arranged on an end board 1*a*, and a revolving scroll member 2 shown in FIG. 7B in which a centrifugal wall 2*b* is arranged on an end board 2*a*. These scroll members 1 and 2 are combined together in such a way that the centrifugal walls 1*b* and 2*b* engage with each other and are shifted from each other with a certain angle of dislocation, which is about 180 degrees (180°). In the engaged state of the scroll members, the revolving scroll member 2 is revolved so that a closed space being formed between the centrifugal walls 1*b* and 2*b* moves inwardly from its outer position to its inner position while being gradually reduced in volume. Thus, it is possible to perform fluid compression in the compression space.

The closed space located in its innermost position bears a high pressure, whereas the closed space located in its outer position becomes low in pressure. This causes reaction of compressed gas in the center portion of the centrifugal walls 1*b* and 2*b* combined together. Repeatedly revolving the scroll member 2 causes repetition of the reaction of the compressed gas being effected in the center portions of the centrifugal walls 1*b* and 2*b*. The center portions also correspond to spiral-starting portions of the centrifugal walls 1*b* and 2*b*, which bear shortage of rigidity. Therefore, fatigue failure may occur at root portions at which the centrifugal walls 1*b* and 2*b* are respectively affixed to the end boards 1*a* and 2*a*.

A second example of the scroll compressor disclosed in Japanese Unexamined Patent Publication No. Sho 59-58187 is provided to solve the aforementioned problem, which will be described with reference to FIG. 8.

FIG. 8 shows a center portion (or a spiral-starting portion) of a centrifugal wall 3 of the scroll member installed in the scroll compressor, wherein involute curves are drawn with respect to an exterior and an interior of the centrifugal wall 3 respectively. A first position is fixed at a certain involute angle $\alpha$ on the first involute curve corresponding to the exterior of the centrifugal wall 3, while a second position is fixed at an involute angle ($\alpha$+180°) on the second involute curve corresponding to the interior of the centrifugal wall 3. In addition, a small circular arc is drawn with respect to the first position on the first involute curve, while a large circular arc is drawn with respect to the second position on the second involute curve. Hence, the center portion of the centrifugal wall 3 is formed by connecting the involute curves with the circular arcs. Thus, it is possible to increase the thickness of the centrifugal wall 3 at its center portion, which yields an improvement in strength. However, the aforementioned technique does not provide sufficient improvement in rigidity because a high concentration of stress still remains in proximity to the small circular arc of the center portion of the centrifugal wall 3.

A third example of the scroll compressor disclosed in Japanese Unexamined Patent Publication No. Hei 9-68177 provides a further improvement in rigidity, which will be described with reference to FIGS. 9A and 9B.

That is, it is characterized by providing stepped wall surface portions for both of the fixed and revolving scroll members. FIGS. 9A and 9B show a centrifugal wall 4 installed in the scroll compressor, wherein a stepped wall surface portion is formed between a first position, which is fixed at a certain involute angle $\alpha$ on an involute curve corresponding to an exterior of the centrifugal wall 4, and a second position which is fixed at an involute angle ($\alpha$+180°) on an involute curve corresponding to an interior of the centrifugal wall 4. A closed space is defined as a combination of a spiral-inside closed space and a spiral-back-side closed space being formed between the centrifugal walls of the scroll members combined together, and its volume changes in response to engaged states of the scroll members. The center portions of the centrifugal walls of the scroll members combined together are shaped to establish a profile of complete engagement in which the volume of the closed space at its innermost position becomes substantially zero. In addition, the thickness of the stepped wall surface portion of the centrifugal wall 4 is changed in such a step-by-step manner that the thickness is gradually reduced upwards from the end board. Due to the provision of the stepped wall surface portion for the center portion of the centrifugal wall, it is possible to selectively increase the thickness of the center portion of the centrifugal wall at its root portion only. This allows a further improvement in the strength of the scroll member installed in the scroll compressor.

A fourth example of the scroll compressor disclosed in Japanese Unexamined Patent Publication No. Hei 10-68392 will be described with reference to FIG. 10. FIG. 10 shows a centrifugal wall 5 of the scroll member whose center portion has a stepped wall surface portion. In addition, the center portion of the centrifugal wall 5 is partially shaped to allow provision of a root fillet 5*a* in a certain area defined between connection points of spiral curves and circular arcs drawn for the exterior and interior of the centrifugal wall 5. Similarly, a root fillet (not shown) is also provided for another centrifugal wall 6 that engages with the centrifugal wall 5. In order to avoid interference between the root fillets of the centrifugal walls 5 and 6, a gap is provided therebetween in a wall thickness direction. This reduces concentration of stress at the root portion of the centrifugal wall.

Therefore, it is possible to further improve the strength of the scroll member.

The third example of the scroll compressor shown in FIGS. 9A and 9B bears the following problems. The closed space formed between the centrifugal wall of the fixed scroll member and the centrifugal wall of the revolving scroll member has a dead volume at a last step of compression. The dead volume corresponds to the volume of the 'innermost' closed space that is established at a seal-off point, at which the innermost closed space communicates with a second closed space having a crescent shape that is located one lap outside from the innermost closed space. As the dead volume becomes larger, high-pressure gas is subjected to re-expansion, which will cause reduction of the compression efficiency of the scroll compressor.

The aforementioned seal-off point is defined substantially at the moment when the centrifugal walls of the paired scroll members separate from each other or at the moment when the exterior of the centrifugal wall comes into contact with the discharge port (not shown) that is arranged in proximity to the center portion of the end board. Normally, the scroll compressor locates the discharge port on the end board of the fixed scroll member. In addition, the discharge port is located at the position that does not cause problems in the strength of the centrifugal wall of the fixed scroll member and is arranged in proximity to the spiral-inside of the center portion of the centrifugal wall such that the seal-off point emerges at the last step of compression as possible. In order to improve performance of the scroll compressor by reducing the dead volume, it is necessary to maintain the innermost closed space sealed as tightly as possible. Therefore, the optimal engagement of the centrifugal walls of the paired scroll members should be secured substantially at the moment when the centrifugal wall of the revolving scroll member comes into contact with the discharge port, which is located in proximity to the center portion of the end board of the fixed scroll member.

The third example of the scroll compressor shown in FIGS. 9A and 9B is designed such that the stepped wall surface portion is formed on the center portion of the centrifugal wall in order to improve its strength. This increases the number of sealed locations due to new addition of engaging portions that appear between stepped wall surface portions of the centrifugal walls of the paired scroll members in their height directions. Such newly sealed locations should be subjected to slide-contact sealing. This increases dimensions that should be managed in machining of scroll members, which causes an increase in the manufacturing cost. Incomplete sealing causes a leakage of gas from the innermost closed space, which causes a problem that the compression efficiency is reduced.

The fourth example of the scroll compressor shown in FIG. 10 sets engaged portions of centrifugal walls of paired scroll members along with involute curves of the centrifugal walls at the aforementioned seal-off points that depend on the position of the discharge port. For this reason, the fourth example does not cause the foregoing problem of the third example because it secures easy sealing between centrifugal walls. Even in the fourth example of the scroll compressor, the discharge port is located at the prescribed position by which the seal-off points emerge at the last step of compression. Generally speaking, the engaged portions of the centrifugal walls of the paired scroll members frequently emerge along involute curves corresponding to interiors of the centrifugal walls at the seal-off points that are directly determined by the position of the discharge port. Therefore, the fourth example also increases the number of sealed locations due to new addition of engaging portions that appear between stepped wall surface portions of the centrifugal walls of the paired scroll members in their height directions. Such newly sealed locations should be subjected to slide-contact sealing. This increases dimensions that should be managed in machining of scroll members, which causes an increase in the manufacturing cost. Incomplete sealing causes a leakage of gas from the innermost closed space, which causes a problem in that the compression efficiency is reduced.

The aforementioned third example of the scroll compressor shown in FIGS. 9A and 9B is designed to improve the strength by increasing the thickness of the root portion of the centrifugal wall at its center, spiral-starting portion. If the centrifugal wall does not have the stepped portion, the discharge port 5 can be positioned in proximity to the interior of the centrifugal wall, which is shown in FIG. 11A. However, if the centrifugal wall has the stepped portion, the discharge port 5 should be located far from the centrifugal wall, which is shown in FIG. 11B. This increases the dead volume of the closed space formed between the centrifugal walls engaging with each other at the seal-off points, which depend upon the position of the discharge port. Therefore, the third example of the scroll compressor suffers from a problem in that the compression efficiency is reduced due to the formation of the stepped portion along the interior of the centrifugal wall in proximity to the discharge port of the fixed scroll member.

SUMMARY OF THE INVENTION

It is an object of the invention to provide a scroll compressor in which centrifugal walls of scroll members have high strength and which allows easy machining of scroll members.

It is another object of the invention to provide a scroll compressor that does not cause unwanted reduction of the compression efficiency by minimizing dead volume of closed spaces formed between centrifugal walls of scroll members engaging with each other.

Specifically, this invention provides a scroll compressor that comprises a fixed scroll member having a centrifugal wall planted on its end board, a revolving scroll member having a centrifugal wall planted on its end board, wherein these scroll members are combined together in such a manner that their centrifugal walls engage with each other. In addition, a rotation stop mechanism supports the revolving scroll member to revolve with respect to the fixed scroll member while preventing the revolving scroll member from performing self-rotation.

In a first aspect of this invention, each of the centrifugal walls of the paired scroll members is designed in plan in consideration of involute starting points $\beta 1$ and $\beta 2$ for respectively starting the exterior and interior of the spiral-starting portion, and seal-off points $\beta 1'$ and $\beta 2'$ that are set between the involute starting points $\beta 1$ and $\beta 2$, by which the centrifugal walls separate from each other due to revolution of the revolving scroll member. In addition, the spiral-starting portion designed for each of the centrifugal walls comprises non-stepped portions formed in respective areas of $\beta 1$–$\beta 1'$ and $\beta 2$–$\beta 2'$ in which the centrifugal wall has constant thickness in its height direction, and a stepped portion formed in at least a part of an area $\beta 1'$–$\beta 2'$ in which the thickness of the centrifugal wall is changed in such a stepped manner that its lower side is increased in thickness as compared with its upper side. Herein, the centrifugal walls of the paired scroll members engage with each other at their first and second non-stepped portions.

In the above, the non-stepped portions are formed by a first curve β1–β1' and a second curve β2–β2' respectively, whereas the lower side of the stepped portion is formed by third and fourth curves smoothly connected between the points β1' and β2', and the upper side of the stepped portion is formed by fifth and sixth curves smoothly connected between the points β1' and β2'. In addition, a first compression space (C1) is formed between the centrifugal walls of the paired scroll members at their innermost position and communicates with a discharge port formed at the center of the end board of the fixed scroll member due to revolution of the revolving scroll member, and a second compression space (C2) is also formed outside of the first compression space. Further, the seal-off points β1' and β2' substantially match engaging points of the centrifugal walls being established just before the second compression space moves to communicate with the discharge port during revolution of the revolving scroll member.

In a second aspect of this invention, each of the centrifugal walls of the paired scroll members provides a stepped portion in its spiral-starting portion, in which the thickness of the centrifugal wall is changed in a stepped manner such that its lower side is increased in thickness compared to its upper side, so that the stepped portion of the centrifugal wall in plan view is increased in thickness within a thickness increase area (N) encompassed by an upper-side curve representing a curved surface of the upper side of the stepped portion and a lower-side curve representing a curved surface of the lower side of the stepped portion. In addition, the discharge port is located to partly overlap with the thickness increase area by approximately a half portion. Further, the lower side of the stepped portion is partly hollowed to accommodate approximately the half portion of the discharge port so that a hollowed portion is formed to encroach into the thickness increase area in plan view, wherein the hollowed portion is enlarged in the height direction of the stepped portion with the prescribed height (h), which is determined to secure an opening area substantially matching a flow passage sectional area of the discharge port.

BRIEF DESCRIPTION OF THE DRAWINGS

These and other objects, aspects, and embodiments of the present invention will be described in more detail with reference to the following drawing figures, in which.

DESCRIPTION OF THE PREFERRED EMBODIMENTS

This invention will be described in further detail by way of examples with reference to the accompanying drawings.

This invention basically provides a scroll compressor that is composed of a fixed scroll member having a centrifugal wall planted on the surface of its end board and a revolving scroll member having a centrifugal wall planted on the surface of its end board, wherein these scroll members are combined together in such a manner that their centrifugal walls of these scroll members loosely engage with each other; therefore, the fixed scroll member supports the revolving scroll member to allow its regulated revolving motion while prohibiting rotation by itself. Each of the scroll members provides a stepped wall surface portion by which the thickness of the center portion (or spiral-starting portion) of the centrifugal wall is gradually increased at its root portion toward the end board.

First Embodiment

Figure 1:
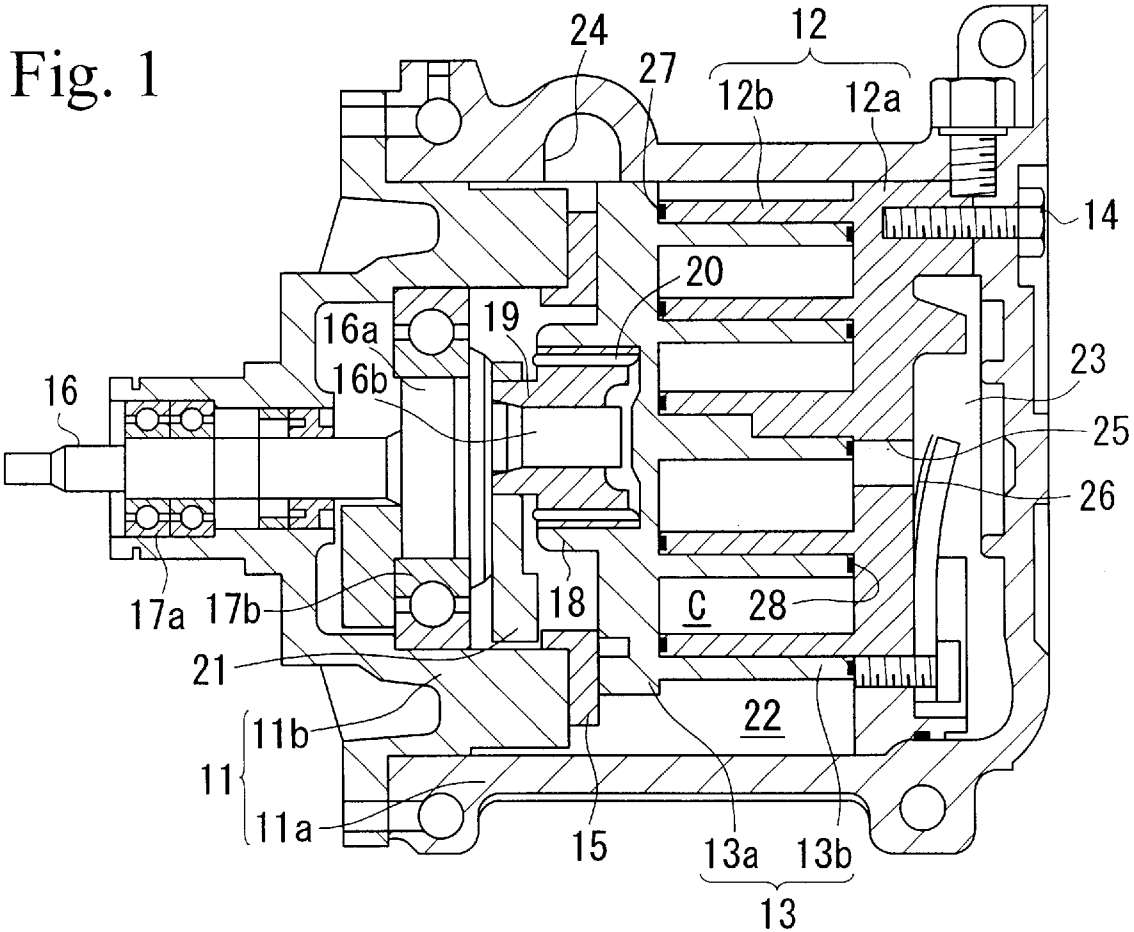
FIG. 1 is a cross sectional view showing the overall structure of the scroll compressor in accordance with the preferred embodiment of the invention.
Figure 2A:
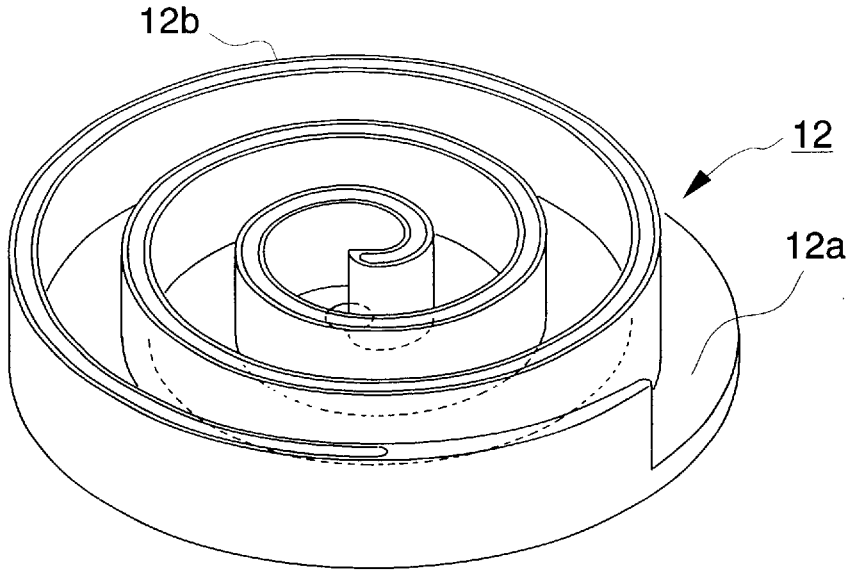
FIG. 2A is a perspective view showing a fixed scroll member for use in the scroll compressor of FIG. 1 in accordance with a first embodiment of the invention.
Figure 2B:
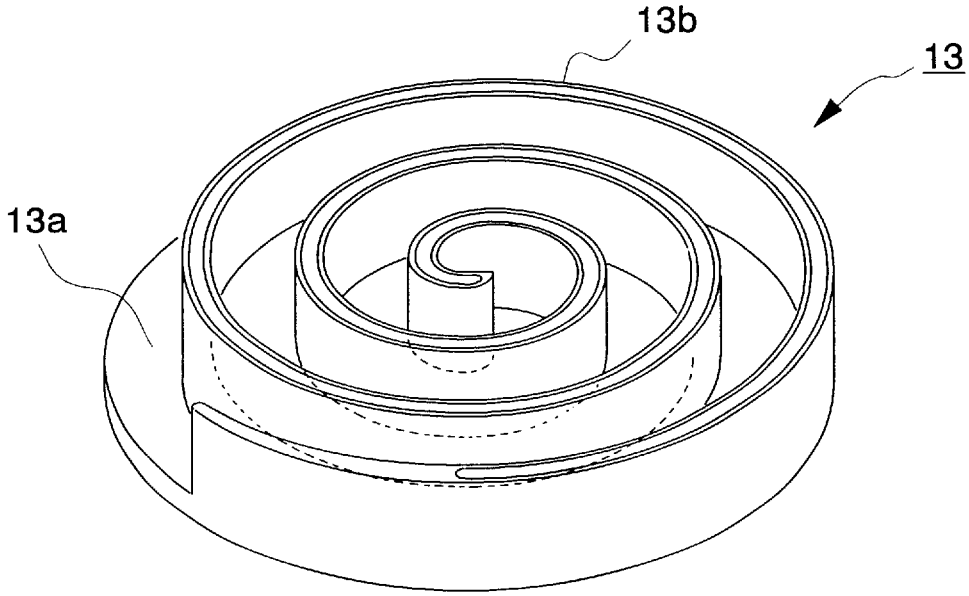
FIG. 2B is a perspective view showing a revolving scroll member for use in the scroll compressor of FIG. 1 in accordance with the first embodiment of the invention.
Figure 3A:
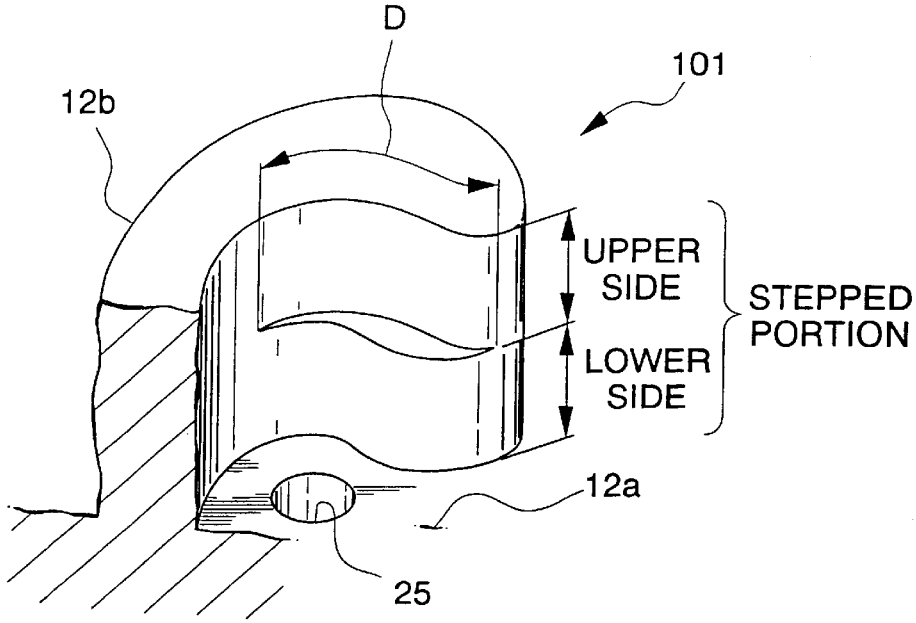
FIG. 3A is a perspective view showing details of the shape of the spiral-starting portion of the centrifugal wall of the scroll member.
Figure 3B:
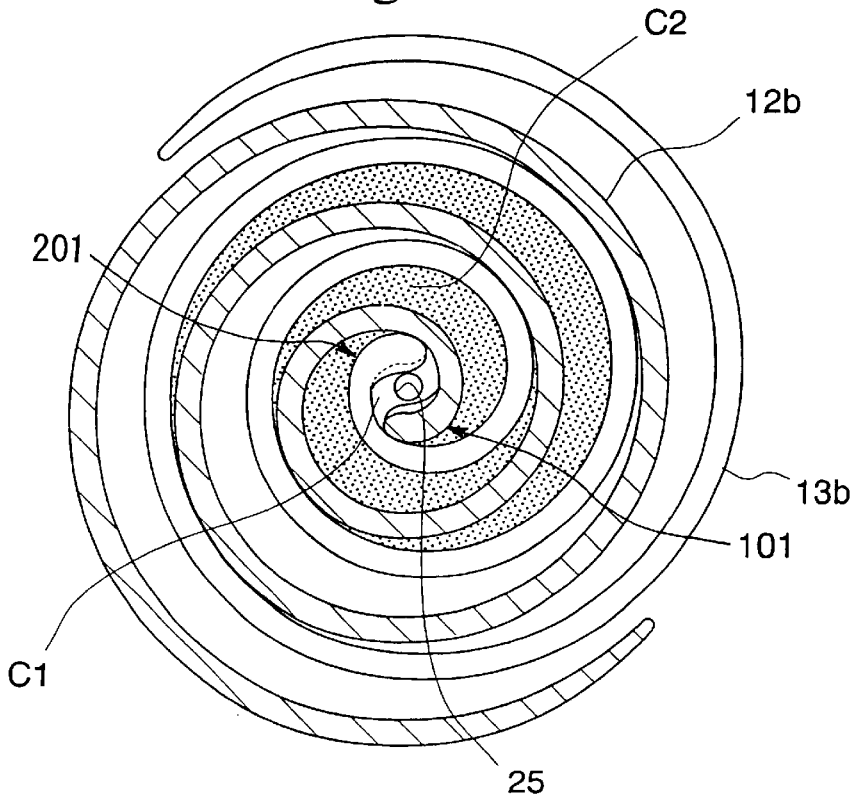
FIG. 3B is a plan view partly in section showing the engaged state of the centrifugal walls of the scroll members shown in FIGS. 2A and 2B with respect to the plane perpendicular to the axial line of the discharge port, which is formed at the center of the end board of the fixed scroll member.
Figure 4:
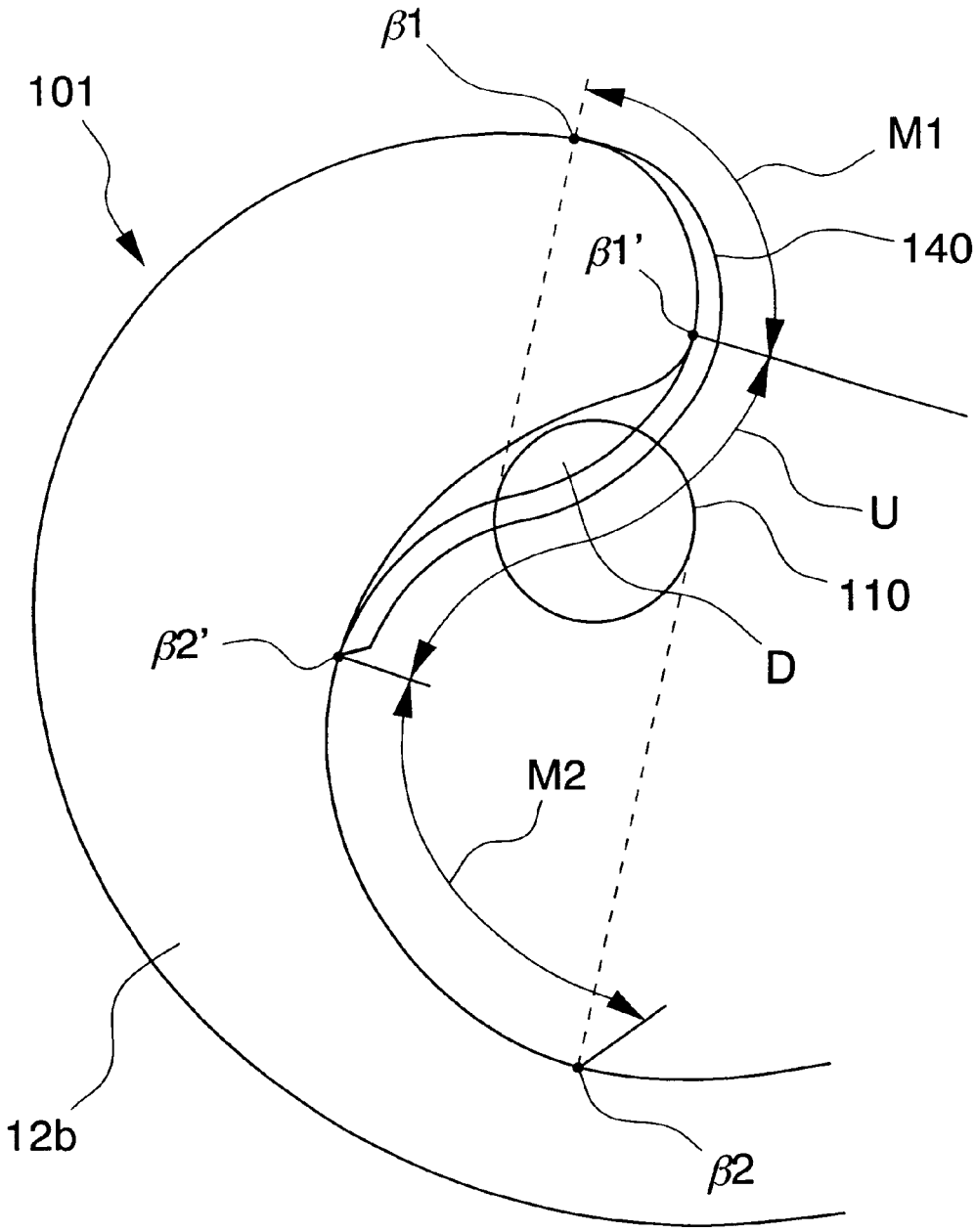
FIG. 4 is a plan view diagrammatically showing the shape and configuration of the spiral-starting portion of the centrifugal wall of the fixed scroll member shown in FIG. 2A.
Figure 5:
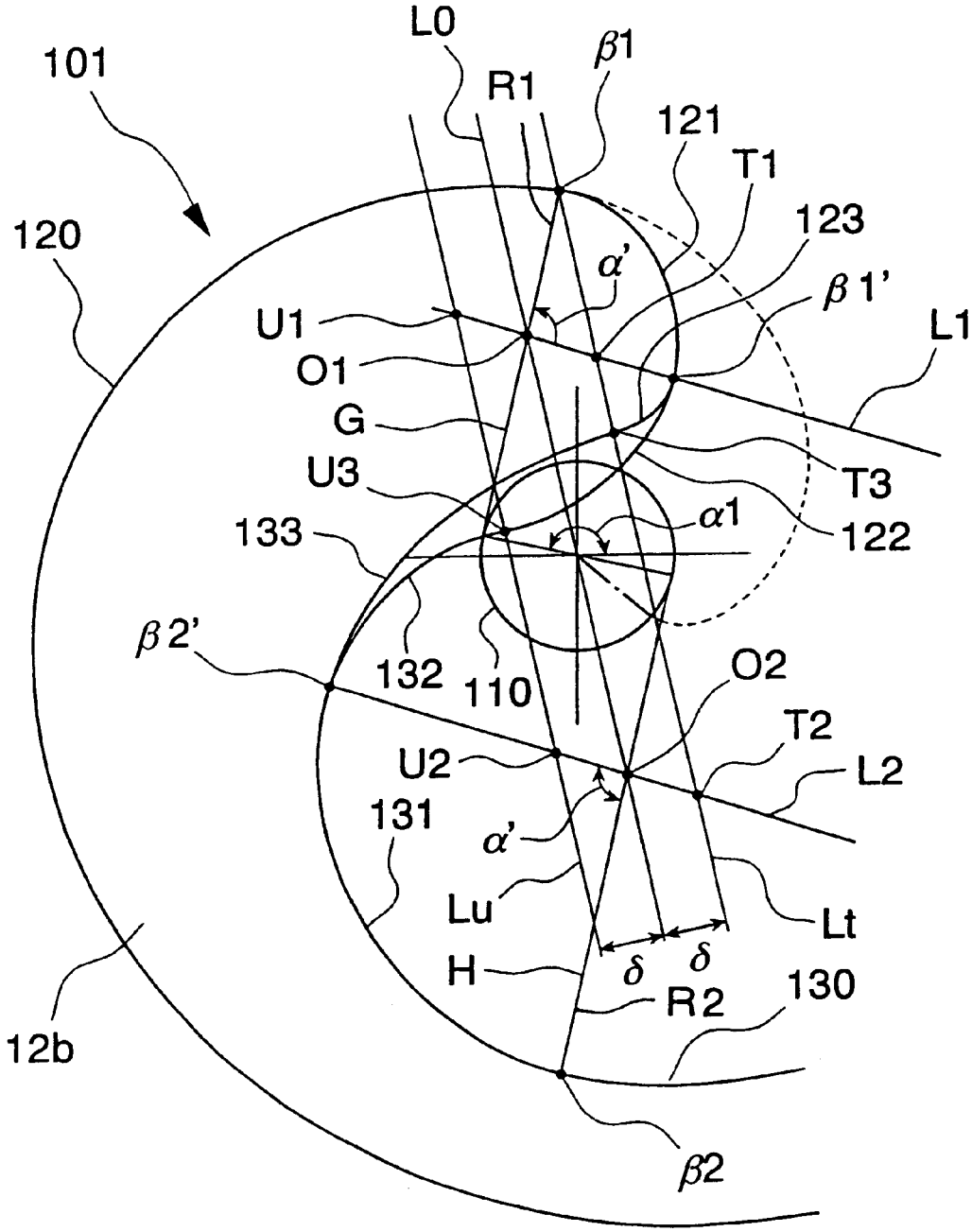
FIG. 5 is a plan view diagrammatically showing details of the shape and configuration of the spiral-starting portion of the centrifugal wall of the fixed scroll member shown in FIG. 2A.

FIG. 1 shows a cross section of the overall structure of the scroll compressor in accordance with a preferred embodiment of the invention, wherein paired scroll members are designed in accordance with the first embodiment of the invention. FIG. 2A shows a perspective view of a fixed scroll member 12 composed of an end board 12*a* and a centrifugal wall 12*b*, and FIG. 2B shows a perspective view of a revolving scroll member 13 composed of an end board 13*a* and a centrifugal wall 13*b*. FIG. 3A shows a perspective view of the spiral-starting portion of the centrifugal wall 12*b* of the fixed scroll member 12, and FIG. 3B shows an engaged state of the fixed scroll member 12 and the revolving scroll member 13. Specifically, FIG. 3B shows a cross section of the fixed scroll member 12 that is observed from the section perpendicular to the axial line of a discharge port 25. FIG. 4 shows an enlarged front view of the spiral-starting portion of the centrifugal wall 12*b* of the fixed scroll member 12. FIG. 5 shows an example of the design plan for formation of the spiral-starting portion of the centrifugal wall 12*b* of the fixed scroll member 12.

The scroll compressor of the present embodiment has technical features in the design and shape for the spiral-starting portion of the centrifugal wall of the scroll member (namely, the fixed scroll member and the revolving scroll member). Before specifically describing their technical features, a brief description will be given with respect to the overall structure of the scroll compressor.

In FIG. 1, reference numeral 11 designates a housing, which is composed of a housing body 11*a* having a cup-like shape and a cover board 11*b* fixed to the opening side of the housing body 11*a*.

The scroll compressor mechanism constituted of the fixed scroll member 12 and the revolving scroll member 13 is installed in the housing 11.

As shown in FIG. 2A, the fixed scroll member 12 is constructed such that the centrifugal wall 12*b* is planted on the surface of the end board 12*a*. As shown in FIG. 2B, the revolving scroll member 13 is constructed such that the centrifugal wall 13*b* is planted on the surface of the end board 13*a*. Both of the centrifugal walls 12*b* and 13*b* have substantially the same shape and configuration. As shown in FIG. 1, chip seals 27 and 28 are respectively attached to the upper ends of the centrifugal walls 12*b* and 13*b* to raise the airtight performance of a compression space C, which is formed between the fixed scroll member 12 and the revolving scroll member 13.

The fixed scroll member 12 is affixed to the housing body 11*a* by bolts 14. The revolving scroll member 13 is combined together with the fixed scroll member 12 and is deflected from the fixed revolving member 12 in an eccentric manner by the revolving radius thereof, wherein the centrifugal wall 13*b* engages with the centrifugal wall 12*b* while being shifted by 180° in phase. A rotation stop mechanism 15 is provided between the cover board 11*b* and the end board 13*a* and supports the revolving scroll member 13 to allow its restricted revolving motion but stop its self-rotation.

A rotation shaft 16 having a crank 16*a* penetrates through a hole of the cover board 11*b* and is supported in a free rotation manner by means of bearings 17*a* and 17*b*.

A boss 18 projects from the center of the backside surface of the end board 13*a* of the revolving scroll member 13. A deflected shaft portion 16*b* of the crank 16*a* is inserted into the boss 18 and is supported in a free rotation manner by means of a bearing 19 and a drive bush 20. Rotating the rotation shaft 16 drives the revolving scroll member 13 to perform its revolving motion. A balance weight 21 is attached to the rotation shaft 16 to cancel an amount of imbalance imparted to the revolving scroll member 13.

An admission space 22 is formed inside of the housing 11 and is located to contain surrounding areas of the fixed scroll member 12. In addition, a discharge cavity 23 is formed by partitioning between the bottom surface of the housing body 11 and the backside surface of the end board 12*a* of the fixed scroll member 12.

The housing body 11 provides an inlet port that introduces low-pressure fluid towards the admission space 22. The fixed scroll member 12 provides a discharge port 25 at the center of the end board 12*a*. The discharge port 25 discharges high-pressure fluid from the compression space C to the discharge port 25 when the compression space C moves to the center portion of the fixed scroll member 12 while gradually reducing its volume. In addition, the fixed scroll member 12 also provides a discharge valve 26 in proximity to the discharge port 25 at the center of the backside surface of the end board 12*a*. The discharge valve 26 works to open the discharge port 25 only when the prescribed pressure or more is applied thereto.

Next, the overall operation of the scroll compressor having the aforementioned structure will be described. First, a motor (not shown) is driven to rotate the rotation shaft 16 about its rotation axis. Thus, the deflected shaft portion 16*b* enables the revolving motion of the revolving scroll member 13 with respect to the fixed scroll member 12, wherein it prevents the revolving scroll member 13 from performing self-rotation. The inlet port 24 introduces low-pressure fluid, which moves inside of the housing 11 to gradually increase the pressure thereof while gradually reducing the volume thereof. Finally, the high-pressure fluid is discharged into the discharge cavity 23 by way of the discharge port 25.

Next, detailed descriptions will be given with respect to the design and shape of the spiral-starting portion of the centrifugal wall of the scroll member with reference to FIGS. 3A, 3B, 4 and 5. In the present embodiment, both of the centrifugal wall 12*b* of the fixed scroll member 12 and the centrifugal wall 13*b* of the revolving scroll member 13 have substantially the same shape and configuration at their center portions. Therefore, descriptions will be given with respect to the spiral-starting portion '101' of the centrifugal wall 12*b* of the fixed scroll member 12.

As shown in FIG. 3A, a stepped portion D is formed at the spiral-starting portion 101 of the centrifugal wall 12*b* of the fixed scroll member 12 so that its thickness is changed in a two-step manner. That is, the thickness of the centrifugal wall 12*b* is increased toward its root portion on the end board 12*a*. In other words, the stepped portion D is designed such that the thickness of the centrifugal wall 12*b* is changed along its height direction, i.e., the direction perpendicular to the plane of the end board 12*a*. Specifically, a lower side (or a root side) of the centrifugal wall 12*b* on the end board 12*a* is increased in thickness while an upper side is reduced in thickness. Such a configuration of the spiral-starting portion 101 of the centrifugal wall 12*b* may be similarly employed by the conventional scroll compressors. In FIG. 3, reference numeral 25 designates a discharge port that is formed at the center of the end board 12*a*.

A first technical feature of the spiral-starting portion 101 is securing the prescribed area of the constant thickness (hereinafter, simply referred to as the constant thickness area) in the height direction in order to maintain the airtight condition of the innermost compression space communicating with the discharge port 25 under the condition where the centrifugal wall 13*b* of the revolving scroll member 13 engages with the centrifugal wall 12*b* of the fixed scroll member 12 as shown in FIG. 3B. In addition, the stepped portion D is carefully arranged outside of the aforementioned constant thickness area. The innermost compression space is called a first compression space C1, while its adjacent compression space located in the upstream side is called a second compression space C2.

The aforementioned shape and configuration of the spiral-starting portion 101 of the centrifugal wall 12*b* in its plan view will be described in detail with reference to FIG. 4. In FIG. 4, reference symbol β1 designates an exterior involute starting point for starting an involute curve being drawn with respect to the exterior of the centrifugal wall 12*b* in its spiral-starting portion 101, and β2 designates an interior involute starting point for starting an involute curve being drawn with respect to the interior of the centrifugal wall 12*b* in its spiral-starting portion 101. In addition, reference symbol β1' designates a seal-off point in relation to the exterior involute starting point β1, and β2' designates a seal-off point in relation to the interior involute starting point β2. Constant thickness areas each having the same thickness dimension in the height direction of the centrifugal wall 12*b* are respectively provided as a non-stepped portion M1 between the aforementioned points β1 and β1', and a non-stepped portion M2 between the aforementioned points β2 and β2'. The paired scroll members engage with each other at their spiral-starting portions by means of the aforementioned non-stepped portions. In addition, a step-shaped portion U corresponding to the aforementioned stepped portion D is formed in an area between the seal-off points β1' and β2'.

Both of the involute starting points β1 and β2 are used to start drawing involute curves about an involute base circle 110. That is, an exterior involute curve starting from the exterior involute starting point β1 is drawn about the involute base circle 110 to realize an exterior wall shape of the centrifugal wall 12*b*, while an interior involute curve starting from the interior involute starting point β2 is drawn about the involute base circle 110 to realize an interior wall shape of the centrifugal wall 12*b*.

In the compression process, the centrifugal walls 12*b* and 13*b* of the paired scroll members 12 and 13 come in contact with each other at prescribed contact points. The seal-off points β1' and β2' correspond to the contact points just when the centrifugal walls 12*b* and 13*b* separate from each other after the compression process. Alternatively, they correspond to engaging points between the centrifugal walls just when the second compression space C2 directly communicates with the discharge port 25.

Relationships between the aforementioned points and lines will be described in more detail with references to FIG. 5. In FIG. 5, reference numeral 120 designates the exterior of the centrifugal wall 12*b* corresponding to the exterior involute curve being drawn from the exterior involute starting point β1, while reference numeral 130 designates the interior of the centrifugal wall 12*b* corresponding to the interior involute curve being drawn from the interior involute starting point β2. The non-stepped portion M1 in its plan view matches a first curve 121 that is drawn between the points β1 and β1', while the non-stepped portion M2 in its plan view matches a second curve 131 that is drawn between the points β2 and β2'. The step-shaped portion D provides a step-like change for the thickness of the spiral-starting portion 101 of the centrifugal wall 12*b* in such a way that the centrifugal wall 12*b* is increased in thickness in its root side on the end board 12*a*. A third curve 122 and fifth curve 123 are drawn from the seal-off point β1', while a fourth curve 132 and a sixth curve 133 are drawn from the seal-off point β2'. The lower side of the step-shaped portion D in its plan view matches the third and fourth curves 122 and 132 that are connected together, while the upper side matches the fifth and sixth curves 123 and 133 that are connected together.

As shown in FIG. 5, the first, third, fourth and second curves 121, 123, 132, and 131 are continuously connected together as a single curve, while the first, fifth, sixth and second curves 121, 123, 133, and 131 are continuously connect together as a single curve.

An example of the method for drawing the aforementioned first to sixth curves will be described in detail with reference to FIG. 5.

An involute line G is drawn as a tangent line with respect to the involute angle α1 of the involute base circle 110 having a radius R0, and it crosses with the exterior involute curve at the aforementioned point β1. Therefore, the exterior involute curve starts from the point β1 in the direction to increase the involute angle, which contributes to the formation of the exterior 120 of the centrifugal wall 12*b*. Similarly, an involute line H is drawn as a tangent line with respect to the involute angle (α1+180°) of the involute base circle 110, and it crosses with the interior involute curve at the point β2. Therefore, the interior involute curve starts from the point β2 in the direction to increase the involute angle, which contributes to the formation of the interior 130 of the centrifugal wall 12*b*.

The first curve 121 extending inwardly from the point β1 is a circular arc having a radius R1, while the second curve 131 extending inwardly from the point β2 is a circular arc having a radius R2. If a revolution radius of the revolving scroll member 13 is denoted by 'R' (not shown), the radius R2 of the second curve 131 can be given by angle α', roughly match the aforementioned points V1 and V2 respectively. Of course, it is not always required that the points β2' and β2' completely match the points V1 and V2. in that case, it is possible to arrange the points β1' and β2' in outside directions from the points V1 and V2 respectively. In other words, these points β1' and β2' can be arranged in prescribed directions to increase their involute angles as compared with the points V1 and V2.

Reference symbol O1 designates the center of the circle corresponding to the first curve 121, and reference symbol O2 designates the center of the circle corresponding to the second curve 131. The seal-off point β1' is set on the first curve 121 in such a manner that an angle between lines β1-O1-β1' is set to α', so that the first curve 121 contributes to the formation of the centrifugal wall 12*b* in its plan view between the points β1 and β1'. In addition, the seal-off point β2' is set on the second curve 131 in such a manner that an angle between lines β2-O2-β2' is set to α', so that the second curve 131 contributes to the formation of the centrifugal wall 12*b* in its plan view between the points β2 and β2'.

The aforementioned step-shaped portion U corresponding to the stepped portion D is formed in the prescribed area of the centrifugal wall 12*b* being defined between the seal-off points β1' and β2', wherein the lower side thereof is increased in thickness as compared with the upper side thereof. When the fixed scroll member 12 engages with the revolving scroll member 13, their stepped portions engage with each other at each side. In order to provide good engagement between the stepped portions of the paired scroll members, it is necessary to design optimal wall surface curves for the stepped portion D, which are drawn using the following auxiliary lines.

That is, an auxiliary line L1 is drawn to connect the points O1 and β1', and an auxiliary line L2 is drawn to connect the points O2 and β2'. These lines L1 and L2 are parallel to each other. An auxiliary line L0 is drawn to connect the points O1 and O2. In addition, an auxiliary line Lt is drawn in parallel to the line L0 while deviating from the line L0 by δ in the direction toward the point β1'. Further, an auxiliary line Lu is drawn in parallel to the line L0 while deviating from the line L0 by δ in the direction toward the point β2'.

Reference symbol U1 designates a point of intersection between the lines L1 and Lu, and T1 designates a point of intersection between the lines L1 and Lt. Reference symbol U2 designates a point of intersection between the lines L2 and Lu, and T2 designates a point of intersection between the lines L2 and Lt.

Next, a description will be given with respect to the method for creating the curves 122 and 132 for the lower side of the stepped portion D by using the aforementioned auxiliary lines.

The third curve 122 extending inwardly from the point β1' is a circular arc that is drawn about the intersecting point U1 by a radius R1+δ, while the fourth curve 132 extending inwardly from the point β2' is a circular arc that is drawn about the intersecting point U2 by a radius R2−δ. These curves 122 and 132 are smoothly connected together at a point U3 on the line Lu.

Next, a description will be given with respect to the method for creating the curves 123 and 133 for the upper side of the stepped portion D by using the aforementioned auxiliary lines.

The fifth curve 123 extending inwardly from the point β1' is a circular arc that is drawn about the intersecting point T1 by a radius R1−δ, while the sixth curve 133 extending inwardly from the point β2' is a circular arc that is drawn about the intersecting point T2 by a radius R2+δ. These curves 123 and 133 are smoothly connected together at a point T3 on the line Lt.

The shape and configuration of the spiral-starting portion 101 of the centrifugal wall 12*b* can be summarized as follows:

The constant thickness portion in which the thickness is made constant in the height direction is formed in the areas respectively defined by the first curve 121 and the second curve 131. The stepped portion D in which the thickness is changed in the height direction is formed in the area defined between the seal-off points β1' and β2'. Specifically, the lower side having the relatively large thickness is defined by the third curve 122 and the fourth curve 132 which are connected together at the point U3, while the upper side having the relatively small thickness is defined by the fifth curve 123 and the sixth curve 133 which are connected together at the point T3. In the stepped portion D, the thickness is changed at a prescribed changeover position, which is set to approximately the center of the centrifugal wall 12*b* in its height direction. Under the engaged state between the paired scroll members, a prescribed gap is formed between the stepped portions of their centrifugal walls at the changeover position. In order to prevent compressed gas from being enclosed between the paired scroll members, it is preferable to set the gap in the range between 0.05 mm and 1.0 mm, for example.

Next, a description will be given with respect to the method for setting the aforementioned angle α', which is used to set the seal-off points β1' and β2'.

Suppose that the first compression space C1 is formed between the spiral-starting portions of the centrifugal walls 12*b* and 13*b* and communicates with the discharge port 25 formed at the center of the end board 12*a* of the fixed scroll member 12, and the second compression space C2 is also formed adjacent to the outside of the first compression space C1. In the engaged state being established just before the second compression space C2 directly communicates with the discharge port 25, the spiral-starting portion 101 of the centrifugal wall 12*b* of the fixed scroll member 12 engages with the spiral-starting portion 201 of the centrifugal wall 13*b* of the revolving scroll member 13 at prescribed points V1 and V2 (not shown). In this case, it is preferable that the seal-off points β1' and β2', which are determined based on the angle α', roughly match the aforementioned points V1 and V2 respectively. Of course, it is not always required that the points β1' and β2' completely match the points V1 and V2. In that case, it is possible to arrange the points β1' and β2' in outside directions from the points V1 and V2 respectively. In other words, these points β1' and β2' can be arranged in prescribed directions to increase their involute angles as compared with the points V1 and V2.

Next, a description will be given with respect to the deviation value σ used for setting the aforementioned lines Lt and Lu, which are drawn in parallel to the line L0. Adequately setting the deviation value σ, it is possible to optimally adjust a difference of thickness between the lower side and upper side of the stepped portion D, wherein the lower side of the stepped portion D is defined by the second and fourth curves 122 and 132 while the upper side is defined by the fourth and sixth curves 123 and 133. Herein, it is preferable to set the deviation value σ in consideration of the strength of the centrifugal wall 12*b*. In general, scroll members are processed by an end mill. From the point of view of productivity, it is preferable to process the scroll members by the end mill having a large diameter, it may be possible to improve the accuracy and yield in production. For this reason, it is possible to determine the deviation value σ in response to the curvature of the fourth curve 132, which provides a minimal radius portion for the centrifugal wall 12*b*.

At each of the root portions of the spiral-starting portions 101 and 201 of the paired scroll members 12 and 13, there is provided a fillet 140 to reduce the concentration of stress as shown in FIG. 4. The fillet 140 is arranged in proximity to the prescribed area of the centrifugal wall 12*b* defined between the points β1 and β2'. In the present embodiment, the fillet 140 is integrally formed with each of the scroll members 12 and 13 at its comer portion whose radius is approximately equal to R1. The fillet 140 can be formed by the prescribed method containing the following steps:

(i) The scroll member is subjected to processing using an end mill (not shown) whose end surface periphery has a desired fillet shape; thus, the fillet 140 is being formed at the root portion of the spiral-starting portion of the scroll member.

(ii) Unwanted portions of the fillet 140 are removed using another end mill whose end surface periphery has an approximately rectangular shape.

Normally, a high processing accuracy is required for the machining of the scroll members. Therefore, the final shape of the fillet is finished by performing the end mill process two or more times. Hence, the second step of the end mill process for removing the unwanted portions of the fillet is likely performed simultaneously with the finishing process for the wall surface of the centrifugal wall. For this reason, the end mill process does not necessarily increase the number of steps in processing of the scroll member.

In order to prevent the fillet of one scroll member from interfering with another scroll member, a chamfer (not shown) is provided at each of upper end surfaces of the centrifugal walls 12*b* and 13*b*. The fillet 140 is formed in the restricted area at the root portion of the centrifugal wall 1 2*b* defined between the points β1 and β2', which is shown in FIG. 4. Therefore, the centrifugal wall 12*b* of this area is processed by the special end mill that differs from the end mill for use in processing of other areas of the centrifugal wall 12*b*. This may cause a large process tolerance for this area of the centrifugal wall 12*b*. Hence, it is preferable to set a small gap in design for this area of the centrifugal wall 12*b*. The present embodiment allows the cutter process being effected to finish the final shape of the centrifugal wall 12*b* in the area defined between the points β2' and β2 because the area for providing the fillet 140 is limited in the aforementioned area defined between the points β1 and β2'. As a result, it is possible to improve the processing accuracy for finishing wall surfaces of the centrifugal wall 12*b*.

The present embodiment describes the first through sixth curves 121, 122, 123, 131, 132, and 133 used for the formation of the wall surface of the centrifugal wall 12*b* in the area between the points β1 and β2 are formed by circular arcs to allow smooth connection therebetween. This invention is not necessarily limited to the present embodiment; hence, it is possible to modify the present embodiment such that a part of the curves or all of the curves are formed by elliptical arcs to allow smooth connection therebetween. Alternatively, it is possible to modified the present embodiment such that straight lines are combined together with circular arcs or elliptical arcs to achieve smooth connection therebetween.

In addition, the present embodiment describes that involute curves are used for the shape and configuration of the centrifugal walls 12*b* and 13*b*. It is possible to design the centrifugal walls by using curves that are produced by mathematically correcting the involute curves or by using curves having similar characteristics of the involute curves.

Further, the present embodiment describes that the same shape and configuration of the spiral-starting portion 101 of the centrifugal wall 12*b* of the fixed scroll member 12 are similarly used for the spiral-starting portion 201 of the centrifugal wall 13*b* of the revolving scroll member 13. Of course, it is possible to provide a different shape and configuration for the spiral-starting portion 201 of the centrifugal wall 13*b* of the revolving scroll member 13 as compared to the spiral-starting portion 101 of the centrifugal wall 12*b* of the fixed scroll member 12. In that case, the constant thickness portion in which the centrifugal wall has a constant thickness in its height direction is formed with respect to the area between the points β1 and β1' and the area between the points β1 and β2' respectively, so that non-stepped portions are formed for these areas to allow mutual engagement between the spiral-starting portions of the paired scroll members, whereas the step-shaped portion in which the thickness of the centrifugal wall is changed in a stepped manner is formed with respect to the area between the points β1' and β2'.

The scroll compressor of the first embodiment has a variety of technical features and effects, which will be described below.

(1) The scroll compressor of the present embodiment is composed of a fixed scroll member 12 and a revolving scroll member 13 that mutually engage with each other at spiral-starting portions (101, 201) of their centrifugal walls (12*b*, 13*b*). The present embodiment is characterized by providing the special shape and configuration for the spiral-starting portion of the centrifugal wall with respect to the prescribed area defined between the exterior involute starting point β1, which is set for starting an exterior involute curve drawn for the formation of the exterior of the centrifugal wall, and the interior involute starting point β2 which is set for starting an interior involute curve drawn for the formation of the interior of the centrifugal wall. Specifically, dimensions of the centrifugal wall are determined in such a way that the constant height portion in which the centrifugal wall has a constant thickness in its height direction is formed with respect to the first area between the points β1 and β1' and the second area between the points β2 and β2' respectively while the step-shaped portion in which the height of the centrifugal wall is changed in a stepped manner is formed with respect to the third area between the points β1' and β2'. In other words, the non-stepped portions M1 and M2 by which the centrifugal walls of the paired scroll members engage with each other at their spiral-starting portions during the revolving motion of the revolving scroll member 13 are formed with respect to the first and second areas respectively, while the stepped portion D corresponding to the step-shaped portion U is formed with respect to the third area.

(2) Due to the provision of the stepped portion in the prescribed area of the centrifugal wall defined between the points β1' and β2', it is possible to rationally increase the thickness of the root portion of the spiral-starting portion of the centrifugal wall of the scroll member, which may be placed in severe conditions due to reaction of the gas being compressed. That is, the scroll compressor of the present embodiment can secure the sufficient strength for resisting the reaction of the compressed gas in its scroll members.

(3) The non-stepped portions M1 and M2 allowing mutual engagement between the centrifugal walls of the paired scroll members are formed with respect to the first area between the points β1 and β1' and the second area between the points β2 and β2', wherein these areas are important for maintaining the airtight condition (or sealed condition) of the first compression space C1 that directly communicates with the discharge port 25 during the revolving motion of the revolving scroll member 13, which revolves in association with the fixed scroll member 12. The centrifugal walls of the paired scroll members engage with each other at their non-stepped portions because the non-stepped portions hardly cause leakage of gas as compared with stepped portions. In addition, it is possible to reduce the number of steps in processing with a high accuracy because steps are not required for the non-stepped portions. This contributes to an improvement of the processing ability of the scroll compressor.

(4) Because of the provision of the step-shaped portion U with respect to the area between the seal-off points β1' and β2' that work during the revolving motion of the revolving scroll member 13 revolving in association with the fixed scroll member 12, it is possible to increase the strength of the centrifugal wall by increasing the thickness of its lower side in the stepped portion D. In addition, the stepped portion D does not deteriorate the sealing ability of the first compression space C1 communicating with the discharge port 25. Therefore, the compression efficiency would not be reduced by the provision of the stepped portion D. In other words, since the present embodiment is designed such that the centrifugal walls of the paired scroll members can easily engage with each other, it is possible to easily reduce the volume of the closed space corresponding to the 'innermost' first compression space C1. As a result, it is possible to reduce the dead volume, which yields a high compression efficiency. For this reason, the stepped portion D does not require the high-accuracy processing because it does not affect the sealing ability. This contributes to an improvement in the processing ability of the scroll compressor.

(5) As described above, the present embodiment provides a scroll compressor that is increased in strength of the centrifugal walls of the scroll members and is improved in processing ability without causing reduction of compression efficiency because of the special design for use in the formation of the spiral-starting portion of the centrifugal wall of the scroll member.

(6) The present embodiment provides constant height portions (i.e., non-stepped portions M1 and M2) in which the centrifugal wall has a constant thickness in its height direction with respect to the aforementioned first and second areas respectively while providing a stepped portion D (or step-shaped portion U) in which the thickness of the centrifugal wall is changed in a stepped manner with respect to the third area defined between the seal-off points. These areas can be adequately set by using the prescribed variable corresponding to the aforementioned angle α'. In addition, the difference in thickness between the upper side and lower side of the stepped portion D can be adequately set by using the prescribed variable corresponding to the deviation value δ. For example, when the deviation value δ is increased, it is possible to increase the strength of the centrifugal wall at its spiral-starting portion by increasing radiuses of the small circular arcs being drawn for the formation of the stepped portion D. When the deviation value δ is decreased so that the minimal radius of the fourth curve 132 is being increased, it is possible to improve the yield in processing of scroll members by enlarging the diameter of the end mill used for processing the scroll members. Thus, the present embodiment increases the degree of freedom in designing of the centrifugal walls of the scroll members.

(7) The present embodiments set the seal-off points β1' and β2' to substantially match the aforementioned points V1 and V2 of the centrifugal walls 12*b* and 13*b* engaging together just before the second compression space C2 directly communicates with the discharge port 25. Therefore, it is possible to realize smooth engagement between the centrifugal walls 12*b* and 13*b*, which is maintained until their engaging points reach the seal-off points directly determined based on the position of the discharge port 25. This allows the volume of the closed space corresponding to the first compression space C1 to be easily reduced to the minimal volume. Hence, it is possible to minimize the dead volume while increasing the compression efficiency. In addition, the scroll compressor is improved in strength at the center portions of the centrifugal walls of the scroll members.

Second Embodiment

Next, a description will be given with respect to the scroll compressor in accordance with the second embodiment of the invention. The second embodiment is basically similar to the foregoing first embodiment, wherein it is characterized by the shape of its center, spiral-starting portion 101 of the centrifugal wall 12*b* and the selected position for the discharge port 25. Details of the second embodiment are shown in FIGS. 6A and 6B.

Similar to the first embodiment, the second embodiment is designed such that the spiral-starting portion 101 of the centrifugal wall 12*b* of the fixed scroll member 12 provides the stepped portion D in which the thickness of the centrifugal wall 12*b* is increased in a step-like manner towards its root portion on the end board 12*a*. In FIG. 6A, the discharge port 25 is located to partly overlap with a thickness increase area N (see hatched part) of the stepped portion D of the centrifugal wall 12*b* on the end board 12*a* of the fixed scroll member 12.

In the spiral-starting portion 101 of the centrifugal wall 12*b*, the stepped portion D provides a stepped change of the thickness in the height direction of the centrifugal wall 12*b*, in other words, in the direction perpendicular to the plane of the end board 12*a*. That is, the lower side corresponding to the root portion on the end board 12*a* has the relatively large thickness, while the upper side has the relatively small thickness.

Figure 6A:
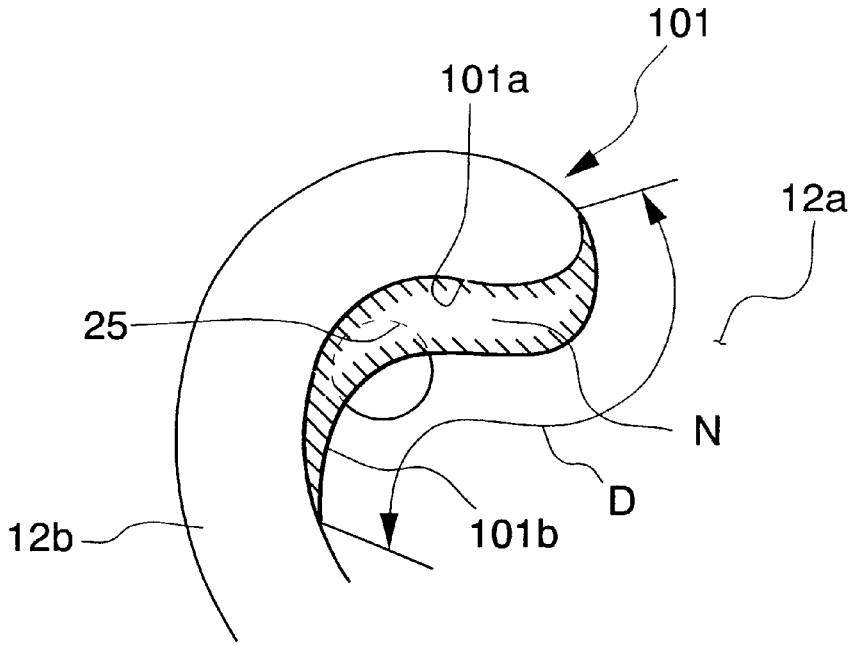
FIG. 6A is a plan view diagrammatically showing a spiral-starting portion of a centrifugal wall of a scroll member for use in a scroll compressor in accordance with a second embodiment of the invention.
Figure 6B:
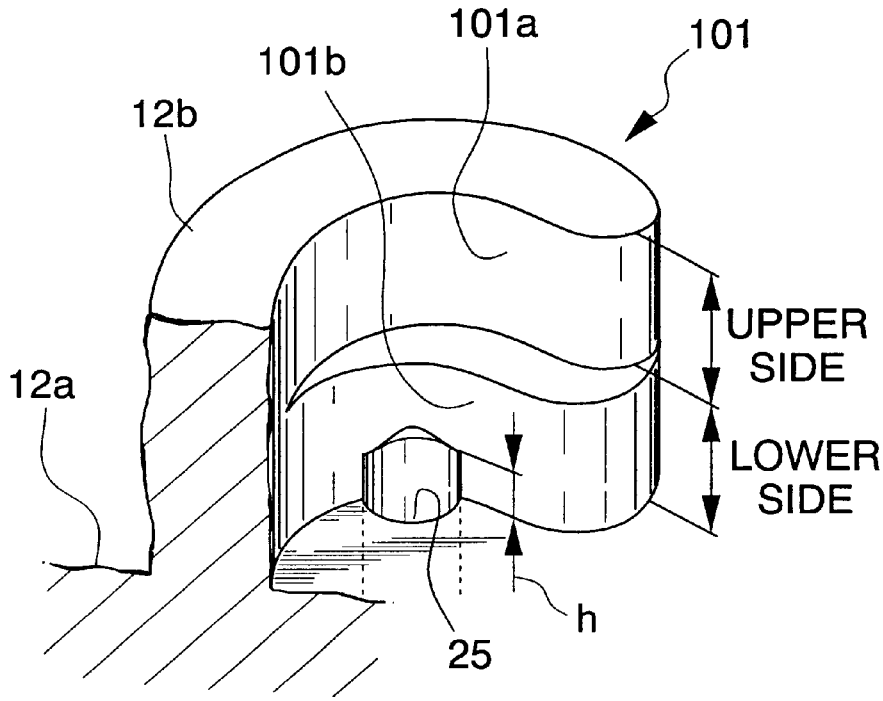
FIG. 6B is a perspective view showing a stepped portion of the centrifugal wall of the scroll member shown in FIG. 6A.
Figure 7A:
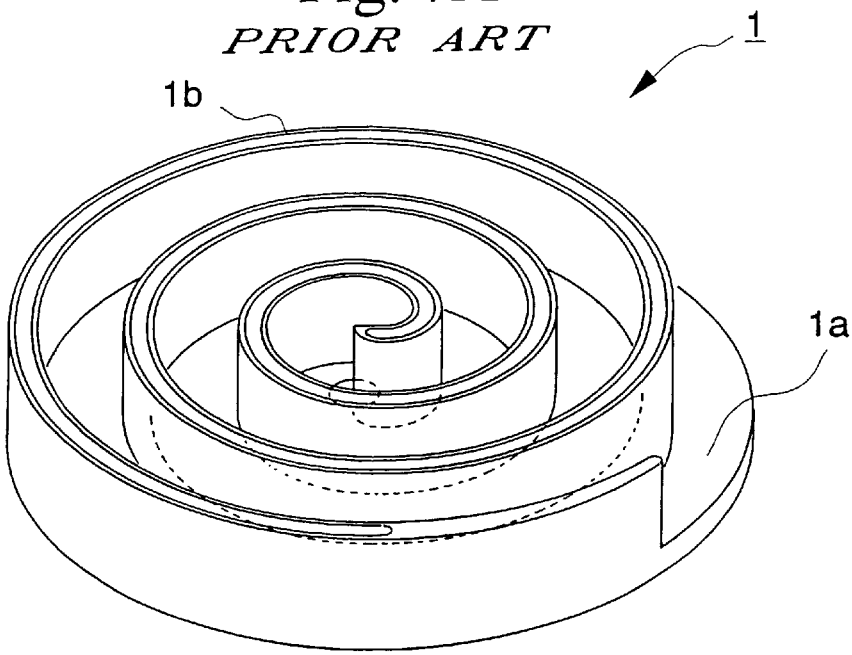
Fig. 7A PRIOR ART
FIG. 7A is a perspective view showing an example of a fixed scroll member installed in the conventional scroll compressor.
Figure 7B:
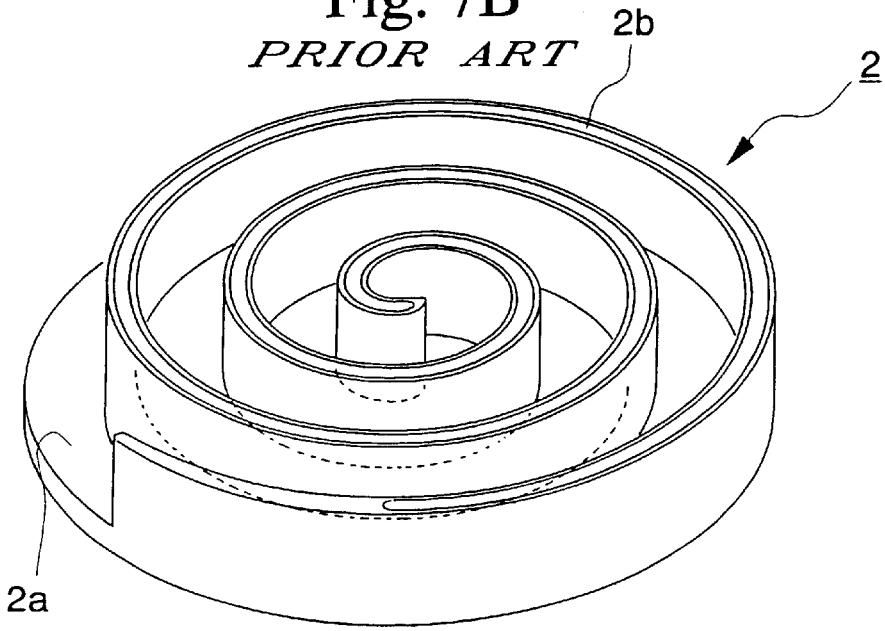
Fig. 7B PRIOR ART
FIG. 7B is a perspective view showing an example of a revolving scroll member installed in the conventional scroll compressor.
Figure 8:
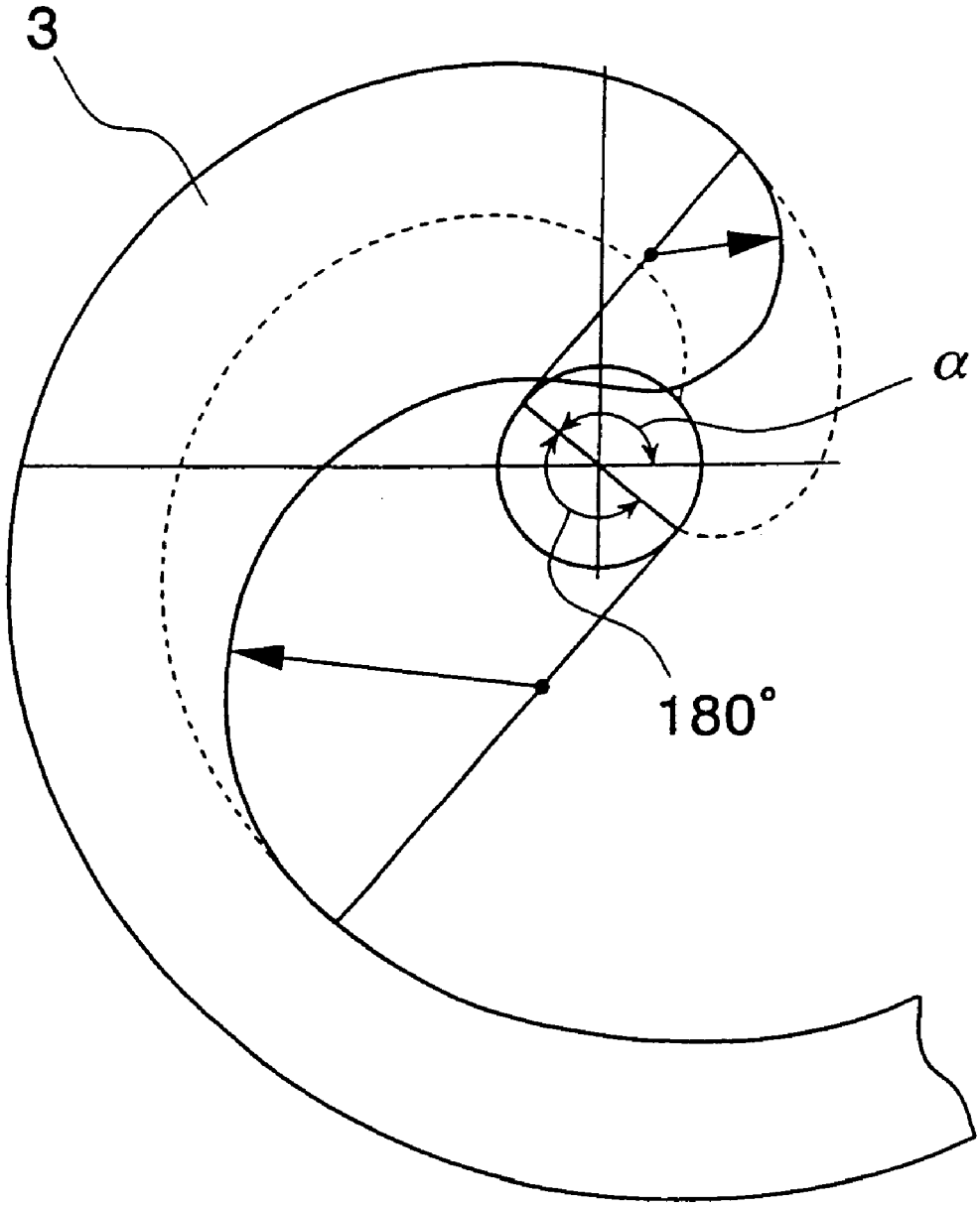
Fig. 8 PRIOR ART
FIG. 8 is a plan view diagrammatically showing a center portion of a centrifugal wall of a scroll member installed in another example of the conventional scroll compressor.
Figure 9A:
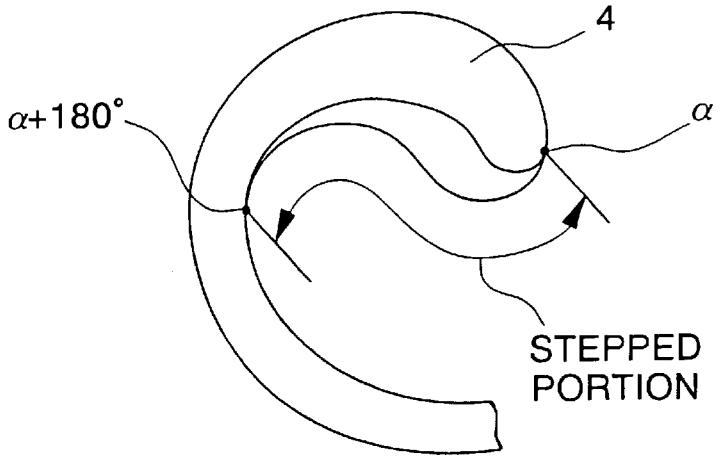
Fig. 9A PRIOR ART
FIG. 9A is a plan view diagrammatically showing a center portion of a centrifugal wall of a scroll member installed in another example of the conventional scroll compressor.
Figure 9B:
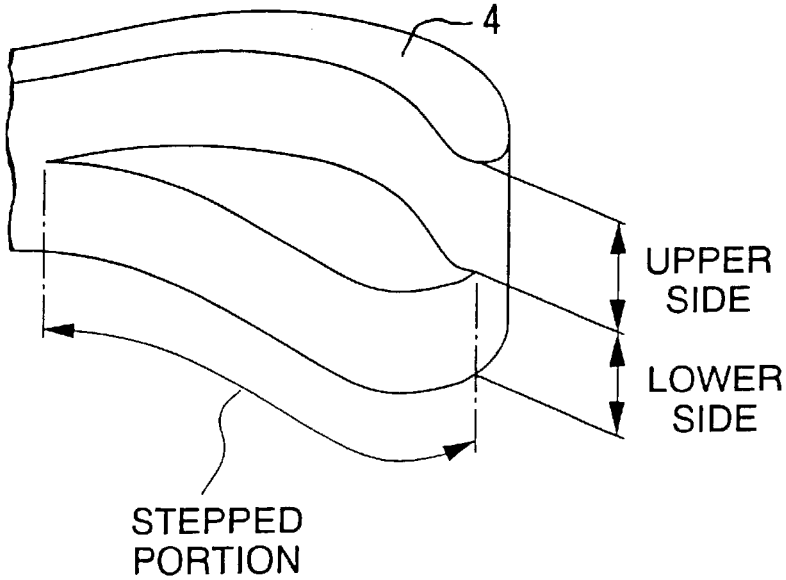
Fig. 9B PRIOR ART
FIG. 9B is a perspective view showing a stepped portion of the centrifugal wall of the scroll member shown in FIG. 9A.
Figure 10:
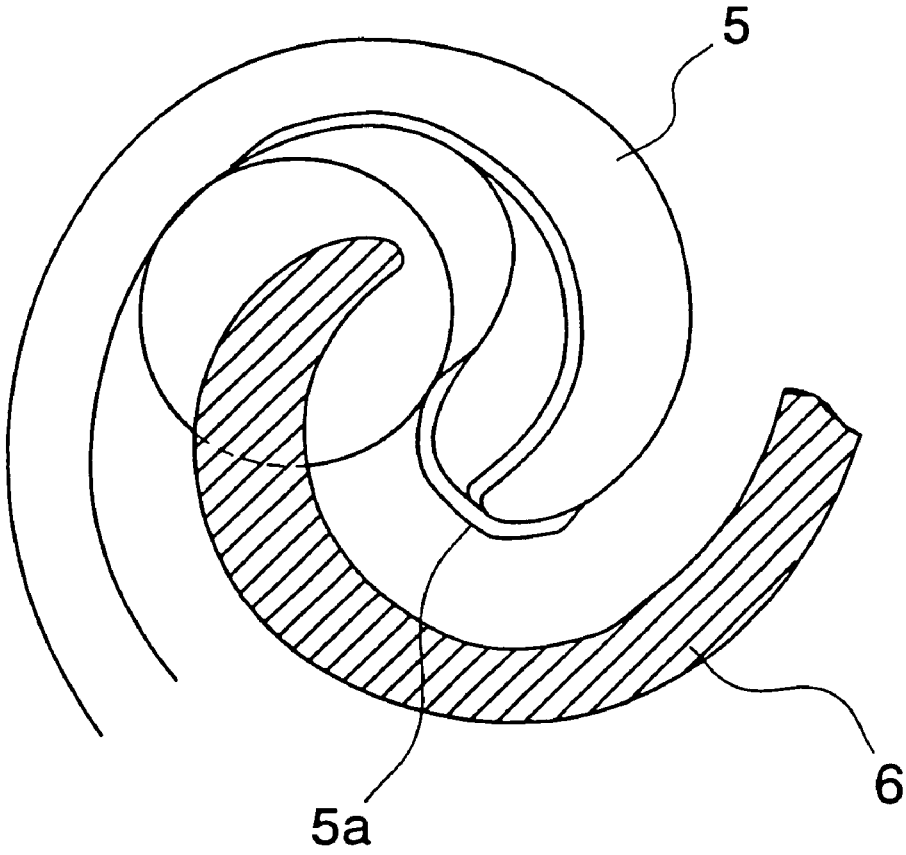
Fig. 10 PRIOR ART
FIG. 10 is a plan view diagrammatically showing a center portion of a centrifugal wall of a scroll member installed in another example of the conventional scroll compressor.
Figure 11A:
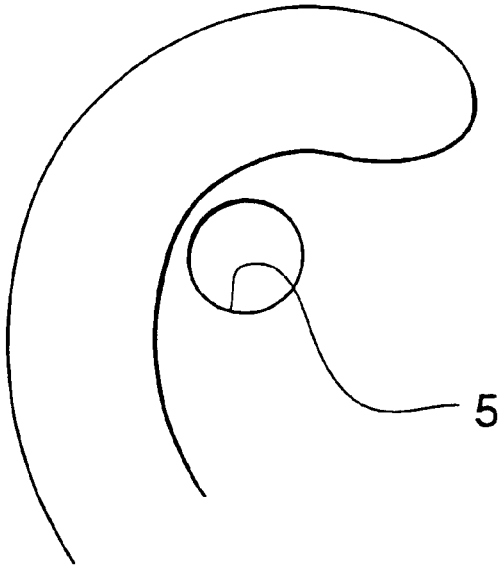
Fig. 11A PRIOR ART
FIG. 11A is a plan view showing the positional relationship between a centrifugal wall and a discharge port of the fixed scroll member.
Figure 11B:
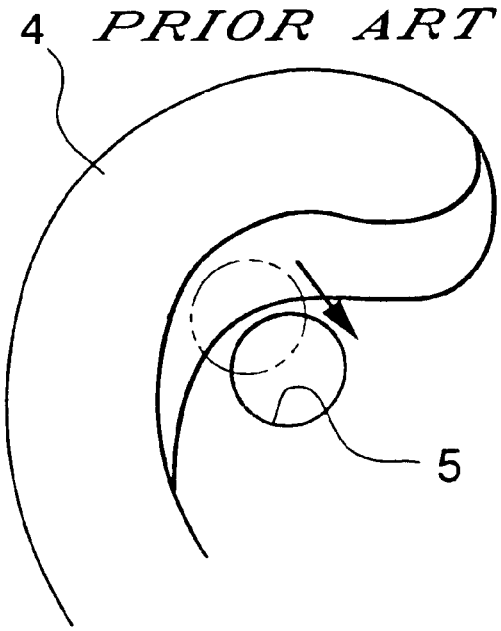
Fig. 11B PRIOR ART
FIG. 11B is a plan view showing positional relationship between a centrifugal wall having a stepped portion and a discharge port of the fixed scroll member.

In FIG. 6A, reference numeral 101*a* designates an upper-side curve representing the curved surface of the upper side of the stepped portion D in its plan view, and reference numeral 101*b* designates a lower-side curve representing the curved surface of the lower side of the stepped portion D in its plan view. The aforementioned thickness increase area N is encompassed by the upper-side curve 101*a* and the lower-side curve 101*b*, in other words, it represents an increase of the thickness of the centrifugal wall 12*b* in the horizontal direction.

In the stepped portion D, the thickness of the centrifugal wall 12*b* is changed in the height direction at the prescribed thickness changeover point, which roughly matches the center of the centrifugal wall 12*b* in its height direction. Thus, the stepped portion D is changed over between the upper side and lower side at the thickness changeover point. In the present embodiment, the prescribed gap ranging between 0.05 mm and 1 mm is provided between thickness changeover points of the centrifugal walls of the paired scroll members which are assembled together. This is because it is preferable that the present embodiment employ the aforementioned range of dimensions for the gap in order to prevent the compressed gas from being tightly closed between the centrifugal walls of the paired scroll members.

Next, a description will be given with respect to the positional relationship between the discharge port 25 and the thickness increase area N.

The present embodiment locates the discharge port 25 to partly overlap with the thickness increase area N of the stepped portion D by approximately a half portion. Viewing from the inside of the spiral-starting portion 101 of the centrifugal wall 12*b* (see FIG. 6B), approximately the half portion of the discharge port 25 is formed by partly hollowing the lower side of the stepped portion D along its lower-side curved surface 101*b*. In FIG. 6A, the overlapped area of the discharge port 25 partly overlapping with the stepped portion D of the spiral-starting portion 101 of the centrifugal wall 12*b* in its plan view is restricted within the range of the thickness increase area N for increasing the thickness of the centrifugal wall 12*b* at the lower side of the stepped portion D. If the spiral-starting portion 101 of the centrifugal wall 12*b* is excessively hollowed out as the discharge port 25 deeply encroaches into the centrifugal wall 12*b* beyond the thickness increase area N, the concentration of stress may occur in such an excessively hollowed portion of the centrifugal wall 12*b* causing reduction of its strength. Preferably, the discharge port 25 may be selectively located in the periphery of the thickness increase area N in consideration of the strength of the centrifugal wall 12*b*.

The lower side of the stepped portion D of the centrifugal wall 12*b* is partly hollowed to match approximately the half portion of the discharge port 25 in the plan view (see FIG. 6A), and the hollowed portion is three-dimensionally enlarged in the height direction with the prescribed height 'h', which is determined to secure a sufficiently large opening area substantially matching the flow passage section area of the discharge port 25. However, if the discharge port 25 excessively encroaches into the thickness increase area N so that the hollowed portion will have a large height h, there is a possibility that the concentration of stress will occur in the hollowed portion. Therefore, it is preferable to determine the height h of the hollowed portion to be as minimal as possible.

The present embodiment determines the height h of the hollowed portion to secure a sufficiently large opening area substantially matching the flow passage sectional area of the discharge port 25.

The scroll compressor of the second embodiment has a variety of technical features and effects, which will be described below.

(1) The stepped portion D provides a stepped change of thickness by which the thickness of the spiral-starting portion 101 of the centrifugal wall 12*b* is increased in a step-like manner towards the root portion on the end board 12*a*, wherein the thickness is increased in the lower side as compared with the upper side in the thickness increase area N. In addition, the discharge port 25 is selectively located to partly overlap with the thickness increase area N by approximately a half portion. The stepped portion D provides the increased thickness for the spiral-starting portion 101 of the centrifugal wall 12*b* that is inevitably subjected to severe conditions in terms of the strength. That is, it is possible to improve the rigidity of the scroll member. Since the discharge port 25 is arranged to partly overlap with the thickness increase area N of the stepped portion D that provides a sufficiently large strength for the root portion of the centrifugal wall 12*b* on the end board 12*a*, it is possible to determined the position of the discharge port 25 such that the discharge port 25 can approach the upper-side curved surface 101*a* of the stepped portion D as closely as possible while the sufficiently large rigidity is secured for the spiral-starting portion 101 of the centrifugal wall 12*b*. Therefore, it is possible to reduce the dead volume of the closed space being formed between the centrifugal walls of the paired scroll members.

(2) It is possible to improve the strength of the spiral-starting portion 101 of the centrifugal wall 12*b* because of the provision of the stepped portion D increasing the thickness in its root portion on the base board 12*a*. In addition, it is possible to increase the compression efficiency of the scroll compressor because of the reduction of the dead volume of the closed space.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A scroll compressor comprising:

a fixed scroll member having a centrifugal wall planted on its end board;

a revolving scroll member having a centrifugal wall planted on its end board, wherein the revolving scroll member is combined together with the fixed scroll member in such a manner that their centrifugal walls engage with each other; and a rotation stop mechanism for supporting the revolving scroll member to revolve with respect to the fixed scroll member while preventing the revolving scroll member from performing self-rotation, wherein each of the centrifugal walls of the fixed scroll member and the revolving scroll member is designed in plan in consideration of an exterior involute starting point β1 for starting an exterior of a spiral-starting portion, an interior involute starting point β2 for starting an interior of the spiral-starting portion, and seal-off points β1' and β2' which are set between the exterior involute starting point β1 and the interior involute starting pint β2 and by which the centrifugal walls separate from each other due to revolution of the revolving scroll member, and wherein the spiral-starting portion designed for each of the centrifugal walls comprises a first non-stepped portion, formed in a first area defined between the points β1 and β1', in which the centrifugal wall has a constant thickness in its height direction, a second non-stepped portion, formed in a second area defined between the points β2 and β2', in which the centrifugal wall has a constant thickness in its height direction, and a stepped portion, formed in at least a part of a third area defined between the seal-off points β1' and β2', in which thickness of the centrifugal wall is changed in a stepped manner such that its lower side is increased in thickness compared to is upper side, whereby the centrifugal walls of the fixed scroll member and the revolving scroll member engage with each other at their first and second non-stepped portions; and wherein a first compression space is formed between the centrifugal walls of the fixed scroll member and the revolving scroll member at their innermost position and communicates with a discharge port formed at the center of the end board of the fixed scroll member due to revolution of the revolving scroll member while a second compression space is also formed outside of the first compression space, and wherein the seal-off points β1' and β2' substantially match engaging points of the centrifugal walls being established just before the second compression space moves to communicate with the discharge port during revolution of the revolving scroll member.

2. A scroll compressor comprising:

a fixed scroll member having a centrifugal wall planted on its end board and a discharge port located approximately at the center of the end board;

a revolving scroll member having a centrifugal wall planted on its end board, wherein the revolving scroll member is combined together with the fixed scroll member in such a manner that their centrifugal walls engage with each other; and a rotation stop mechanism for supporting the revolving scroll member to revolve with respect to the fixed scroll member while preventing the revolving scroll member from performing self-rotation, wherein each of the centrifugal walls of the fixed scroll member and the revolving scroll member provides a stepped portion in its spiral-starting portion, in which thickness of the centrifugal wall is changed in a stepped manner such that its lower side is increased in thickness as compared with it s upper side, so that the stepped portion of the centrifugal wall in its plan view is increased in thickness within a thickness increase area encompassed by an upper-side curve representing a curved surface of the upper side of the stepped portion and a lower-side curve representing a curved surface of the lower side of the stepped portion, and wherein the discharge port is located to partly overlap with the thickness increase area by approximately a half portion.

3. A scroll compressor comprising:

a fixed scroll member having a centrifugal wall planted on its end board and a discharge port located approximately at the center of the end board;

a revolving scroll member having a centrifugal wall planted on its end board, wherein the revolving scroll member is combined together with the fixed scroll member in such a manner that their centrifugal walls engage with each other; and a rotation stop mechanism for supporting the revolving scroll member to revolve with respect to the fixed scroll member while preventing the revolving scroll member from performing self-rotation, wherein each of the centrifugal walls of the fixed scroll member and the revolving scroll member provides a stepped portion in its spiral-starting portion, in which thickness of the centrifugal wall is changed in a stepped manner such that its lower side is increased in thickness as compared with it s upper side, so that the stepped portion of the centrifugal wall in its plan view is increased in thickness within a thickness increase area encompassed by an upper-side curve representing a curved surface of the upper side of the stepped portion and a lower-side curve representing a curved surface of the lower side of the stepped portion, wherein the discharge port is located to partly overlap with the thickness increase area by approximately a half portion, and wherein the lower side of the stepped portion is partly hollowed to accommodate approximately the half portion of the discharge port so that a hollowed portion is formed to encroach into the thickness increase area in the plan view, and wherein the hollowed portion is enlarged in a height direction of the stepped portion with a prescribed height, which is determined to secure an opening area substantially matching a flow passage sectional area of the discharge port.

* * * * *